United States Patent [19]

Isozumi et al.

[11] Patent Number: 4,808,836

[45] Date of Patent: Feb. 28, 1989

[54] COAXIAL ENGINE STARTER

[75] Inventors: Shuzo Isozumi; Kazuhiro Odahara; Toshinori Tanaka, all of Hyogo, Japan

[73] Assignee: Mitsubishi Denki Kabushiki Kaisha, Tokyo, Japan

[21] Appl. No.: 182,594

[22] Filed: Apr. 18, 1988

[30] Foreign Application Priority Data

Apr. 22, 1987 [JP] Japan ..... 60-100650
Apr. 24, 1987 [JP] Japan ..... 60-62860

[51] Int. Cl.[4] ..... F92N 15/00
[52] U.S. Cl. ..... 290/48; 74/6
[58] Field of Search ..... 290/28, 38 R, 48; 74/6, 74/7 R, 7 B; 123/179 R

[56] References Cited

U.S. PATENT DOCUMENTS 4,366,385 12/1982 Williams ..... 290/48 X
4,760,274 7/1988 Isozumi ..... 290/48

*Primary Examiner*—William M. Shoop, Jr.
*Assistant Examiner*—W. E. Duncanson, Jr.
*Attorney, Agent, or Firm*—Sughrue, Mion, Zinn, Macpeak and Seas

[57] ABSTRACT

A coaxial engine starter comprises an electric motor including a yoke, an armature and a hollow armature shaft, an output shaft arranged coaxially with the armature shaft, a planet reduction gear mechanism disposed between the armature shaft and the output shaft for reducing a rotational speed of the armature shaft and rotating the output shaft at a reduced rotational speed, an electromagnetic switch having a plunger ganged with a rod for selectively coupling the output shaft to the planet reduction gear mechanism, a front bracket including an internal gear of the planet reduction gear mechanism and a bearing receiving a radial load and bolt means for securing the front bracket, the electromagnetic switch and the yoke of the motor to an engine bracket, all together. The bolt means pass axially inside said yoke and outside said internal gear and a resilient member is disposed between the front bracket and the engine bracket to absorb undesired vibration and/or shock on the engine side and to provide a higher freedom of engine layout.

5 Claims, 5 Drawing Sheets

COAXIAL ENGINE STARTER

BACKGROUND OF THE INVENTION

The present invention relates to a coaxial engine starter for an internal combustion engine.

FIG. 1 is a cross section of an example of a conventional engine starter which includes a front bracket 1 mounted on an engine side and forming an outer wall of the starter, an output shaft 2 having a front end portion rotatably supported by a bearing 3 of the front bracket 1, an over-running clutch 4 slidably inserted axially into the output shaft 2, an armature shaft 7, an internal gear 8, a planet gear device 9 to be meshed with the internal gear 8, an electromagnetic switch 10 for controlling a current to be supplied to the starter and moving the over-running clutch 4 forwardly (rightwardly), a lever 11 for transmitting the movement of the electromagnetic switch 10 to the over-running clutch 4, a yoke 12 of the starter, a rear bracket 13 and bolts 14 for fixedly securing the front bracket 1, the yoke 12 and the rear bracket 13, all together. The over-running clutch 4 includes a clutch-outer **4*a* having a spline 5, a clutch-inner 4*b* having a pinion 6 and a roller 4*c* disposed between the clutch-outer 4*a* and the clutch-inner 4*b*. The armature shaft 7 includes a gear 7*a* and the latter, the internal gear 8 and the planet gear device 9 constitute a planet reduction gear machanism for reducing a rotational speed of the armature shaft 7**.

In the conventional engine starter constructed as mentioned above, the rotational force of the armature shaft 7 is normally transmitted through the planet reduction gear mechanism to the output shaft 2 and then through the pinion 6 formed on a front portion of the clutch-inner **4*b* of the over-running clutch 4 and meshed with the spline 5 of the output shaft 2 to a ring gear (not shown) of the engine to start the latter. Immediately after a starting of the engine, a rotational force of the engine is transmitted through the ring gear to the pinion 6, so that the rotational speed of the pinion 6 together with the output shaft 2 is increased. Upon such increase of the rotational speed of the pinion 6, which results in a disengagement of the clutch-inner 4*b* of the over-running clutch 4 due to an action of the roller 4*c*, causes the pinion 6 to rotate freely to thereby cut the rotational force applied from the engine to the pinion 6** off.

Since the conventional engine starter includes two shafts 2 and 7, a layout thereof with respect to the engine is relatively difficult. Further, since the front bracket 1 must be machined engine by engine, the manufacturing cost becomes considerable. In addition thereto, there is a problem of eccentricity of the pinion 6 of the over-running clutch 4 due to the fact that vibration or shock on the side of the engine is transmitted to the front bracket 1 connected directly thereto.

SUMMARY OF THE INVENTION

An object of the present invention is to provide a coaxial type engine starter which facilitates a layout with respect to an associted engine by arranging an electric motor and an electromagnetic switch coaxially and in which a front bracket of the starter is easily mounted on an engine bracket.

Another object of the present invention is to provide a coaxial type engine starter in which the front bracket thereof is mounted on the engine bracket screws through resilient members so that mechanical shocks occured on the engine side is absorbed thereby to eliminate an adverse effect thereof to an over-running clutch.

According to the present invention, the motor and the electromagnetic switch are arranged coaxially and the front bracket of the starter serves to support a bearing on which a radial load is extered as well as an internal gear of a planet gear mechanism. Therefore, an assembling of the front bracket of the starter to the engine and a securing thereof to the engine are facilitated. Due to the utilization of the resilient members between the engine and the front bracket as the shock absorber, vibrations and/or mechanical shocks caused by the engine are effectively absorbed and the problem of eccentricity of the over-running clutch is solved.

DETAILED DESCRIPTION OF THE PREFERRED EMBODIMENTS

Figure 1:
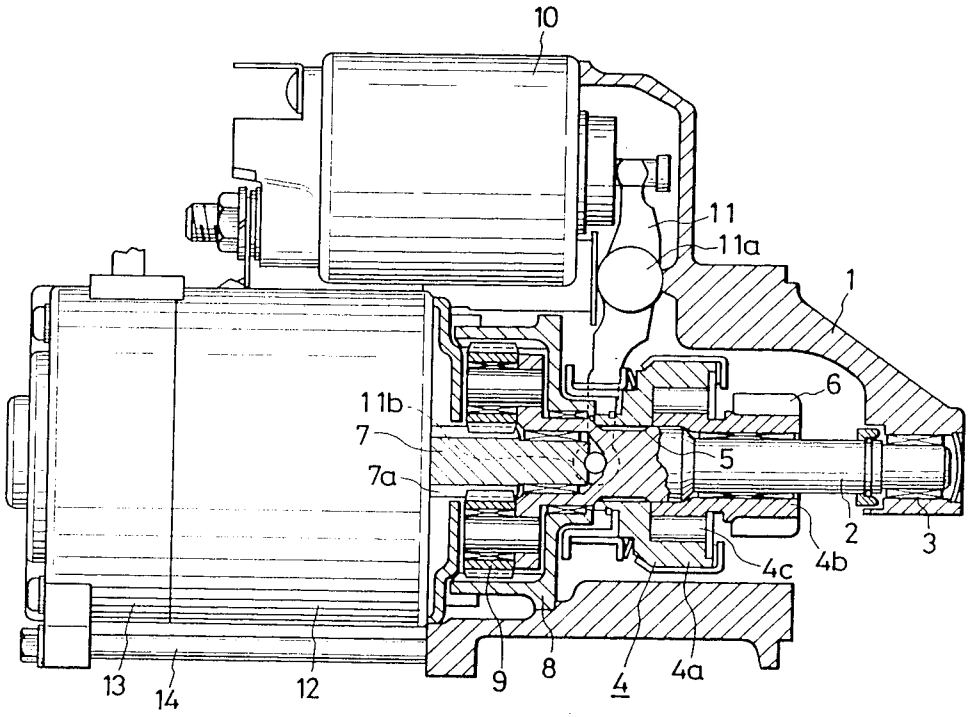
FIG. 1 is a cross section of an example of a conventional engine starter.
Figure 2:
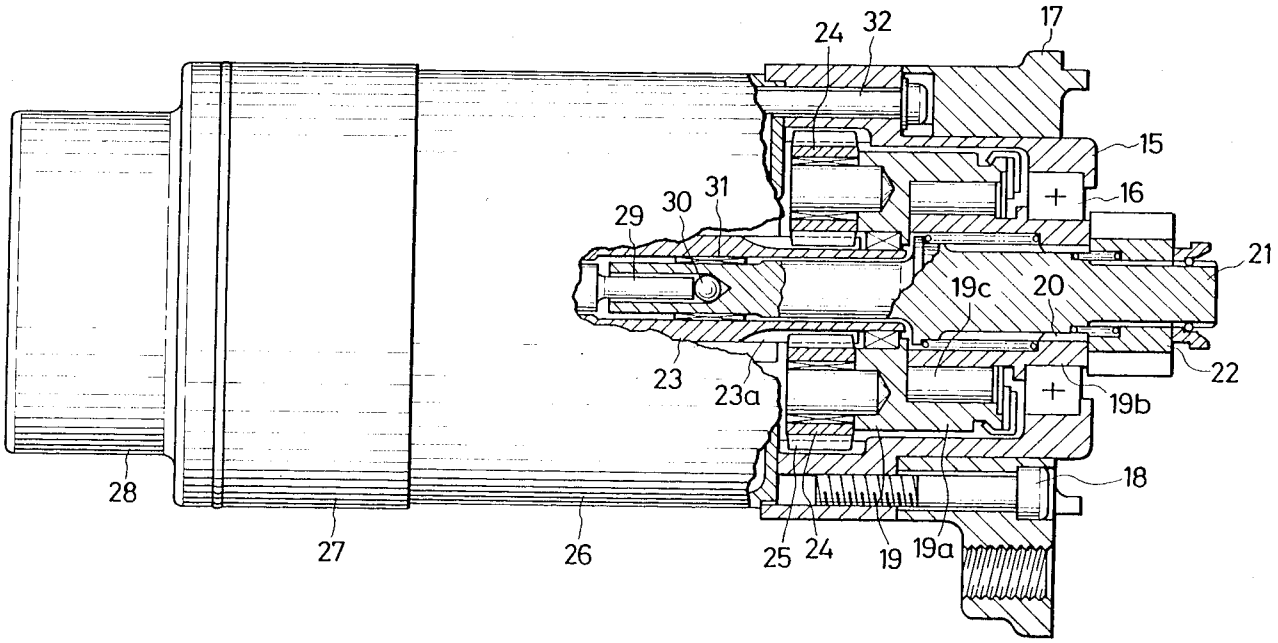
FIG. 2 is a cross section of an embodiment of an engine starter accortding to the present invention.

In FIG. 2 which is a cross section of an embodiment of the present invention, a front bracket 15 of an engine starter supports at a front end thereof a bearing 16 and is secured to an engine side bracket 17 by means of bolts 18. An over-running clutch 19 includes a clutch-outer **19*a*, a clutch-inner 19*b* and a roller 19*c* disposed between the clutch-outer 19*a* and the clutch-inner 19*b*. An inner surface of the clutch-inner 19*b* is splined to form a apline 20 to be meshed with a spline of an output rotary shaft 21. A reference numeral 22 depicts a pinion meshed with a spline formed on a front end portion of the rotary shaft 21 and a hollow armature shaft 23 is formed at a front end thereof with a gear 23*a*. Planet gears 24 mesh with the gear 23*a* and with an internal gear 25 formed on the front bracket 15. The planet gears 24, the gear 23*a* and the internal gear 25** constitute a planet reduction gear mechanism.

A reference numeral 26 depicts a yoke of the starter, 27 a rear bracket, 28 an electromagnetic switch provided on a rear end portion of the starter, 29 a rod inserted into the armature shaft 23 through a plunger and a spring which are not shown, 30 a steel ball disposed between the rod 29 and the output shaft 21, 31 a bearing supporting a rear end of the output shaft 21 and 32 through-bolts for securing the front bracket 15, the yoke 26, the rear bracket 27 and the electromagnetic switch 28 all together. The bolts 32 extend axially outside of the internal gear 25 and inside of the yoke 26.

In operation, when an electric current is supplied to the electromagnetic switch 28, the plunger thereof is retracted to move the output shaft 21 forwardly through the rod 29 to thereby establish a meshing relation between the pinion 22 and an engine ring gear (not shown) so that contacts of the electromagnetic switch 28 are closed. Therefore, an electric current is supplied to an armature of the starter, which is not shown, to rotate the armature. A rotational speed of the armature is reduced by the planet reduction gear mechanism and transmitted through the over-running clutch 19 to the output shaft 21 to start the engine through the pinion 22 and the engine ring gear. Since a rotational force of the engine is transmitted through the ring gear to the pinion 22 in a reverse direction immediately after the engine is started, the pinion 22 is rotated together with the output shaft 21 at an increasing speed, upon which the overrunning cltch-inner **19*b* is disengaged by an effect of the roller 19*c*, so that the pinion 22** can rotate freely to cut the rotational force transmitted from the engine.

Since the coaxial engine starter according to the present invention has the electromagnetic switch provided in a rear portion of the motor portion coaxially and the front bracket 15 mounted onto the engine bracket 17 and supporting the internal gear 25 and the bearing 16 receiving radial load, the mounting of the front bracket 15 onto the engine bracket 17 is facilitated. Further, since the through-bolts 32 pass on the inner surface side of the yoke 26, it is possible to make a configuration of the engine starter cylindrical, which is preferrable for an engine layout.

Figure 3:
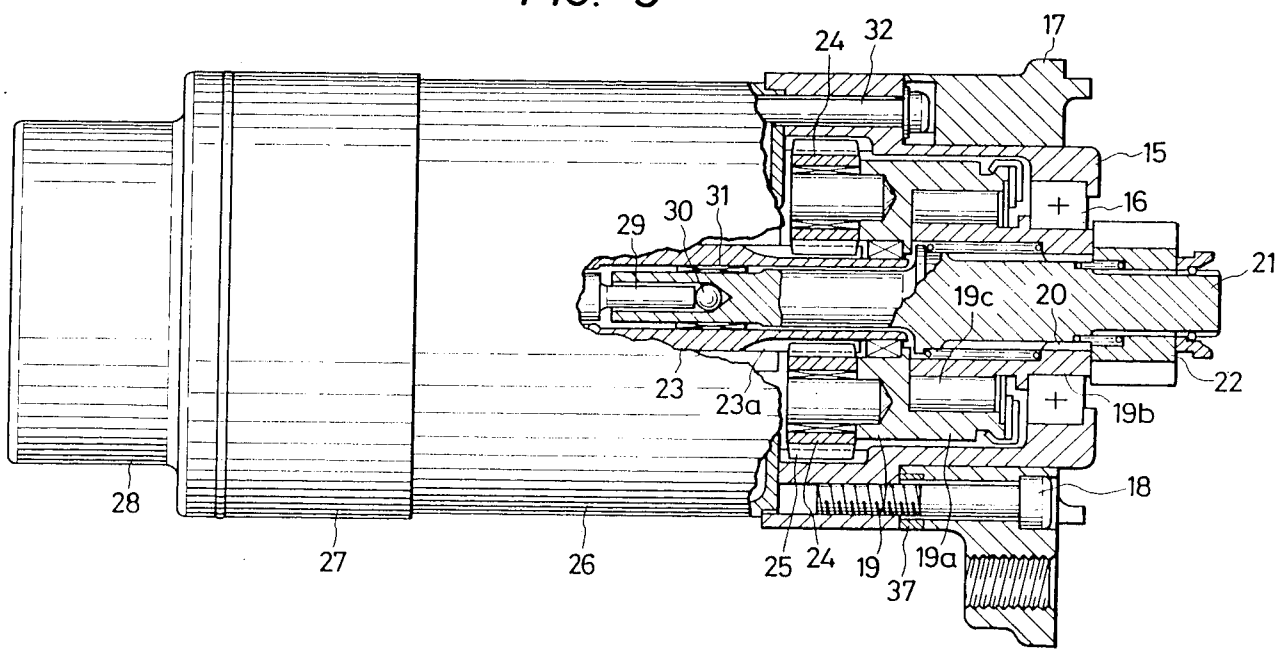
FIG. 3 is a cross section of another embodiment of the present invention.

FIG. 3 shows another embodiment which is different from the engine starter shown in FIG. 2 in that a resilient member 37 is disposed between the front bracket 15 and the engine side bracket 17. The resilient member 37 may be a rubber member or other members such as dish-shaped spring and serves to absorb vibration or shock transmitted from the engine. The resilient member 37 also serves to maintain a proper positional relation between the engine side bracket 17 and the pinion 22 even if the latter is eccentric with respect to the engine block.

Figure 4:
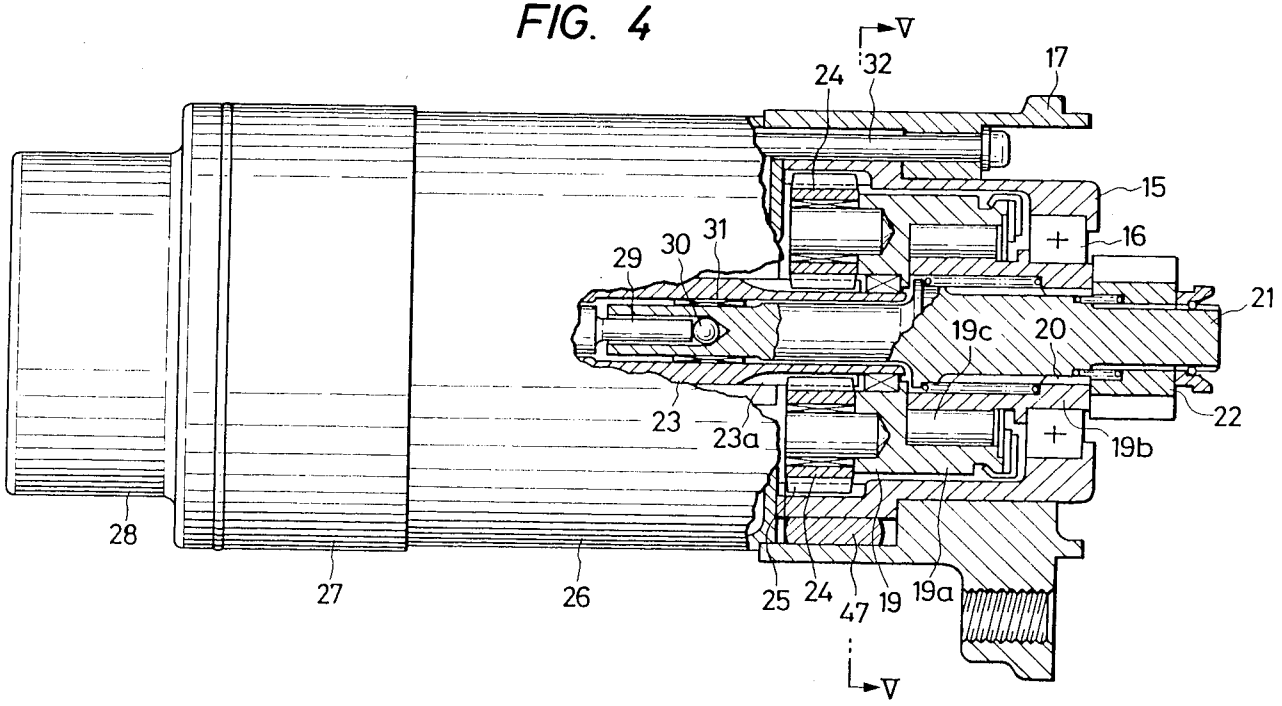
FIG. 4 is a cross section of a further embodiment of the present invention.
Figure 5:
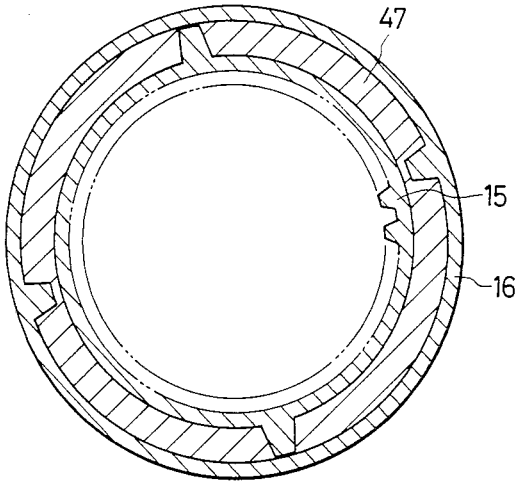
FIG. 5 is a cross section taken along a line V—V in FIG. 4.

FIG. 4 shows a still further embodiment of the present invention and FIG. 5 is a cross section taken along a line V—V in FIG. 4. In this embodiment, the through-bolts 18 in the preceding embodiments are omitted and, instead thereof, an annular resilient member 47 is disposed between an inner preripheral surface of the engine side bracket 17 and an outer peripheral surface of the front bracket 15 and the front bracket 15 is fixed to the engine side bracket 17 by the through-bolts 32. This embodiment is simpler in structure than the embodiment shown in FIG. 3 while providing substantially the same effect.

What is claimed is:

1. A coaxial engine starter comprising an electric motor including a yoke, an armature and a hollow armature shaft, an output shaft arranged coaxially with said armature shaft, a planet reduction gear mechanism disposed between said armature shaft and said output shaft for reducing a rotational speed of said armature shaft and rotating said output shaft at a reduced rotational speed, an electromagnetic switch having a plunger ganged with a rod for selectively coupling said output shaft to said planet reduction gear mechanism, a front bracket including an internal gear of said planet reduction gear mechanism and a bearing receiving a radial load and bolt means for securing said front bracket, said electromagnetic switch and said yoke of said motor to an engine bracket, all together.

2. The coaxial engiee starter as claimed in claim 1, wherein said bolt means pass axially inside said yoke and outside said internal gear.

3. The coaxial engine starter as claimed in claim 2, further comprising a resilient member disposed between said front bracket and said engine bracket.

4. The coaxial engine starter as claimed in claim 3, wherein said resilient member comprises an annular ring of rubber.

5. The coaxial engine starter as claimed in claim 3, wherein said resilient member comprises a dish shaped spring.

* * * * *